US009024219B2

(12) United States Patent
Nakaoka et al.

(10) Patent No.: US 9,024,219 B2
(45) Date of Patent: May 5, 2015

(54) PUSH SWITCH

(71) Applicant: Panasonic Corporation, Osaka (JP)

(72) Inventors: Yusuke Nakaoka, Okayama (JP); Kojiro Yano, Okayama (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 180 days.

(21) Appl. No.: 13/778,639

(22) Filed: Feb. 27, 2013

(65) Prior Publication Data

US 2013/0270093 A1 Oct. 17, 2013

(30) Foreign Application Priority Data

Apr. 12, 2012 (JP) ..... 2012-090766

(51) Int. Cl.
*H01H 13/48* (2006.01)
*H01H 13/14* (2006.01)
*H01H 13/85* (2006.01)

(52) U.S. Cl.
CPC ..... *H01H 13/14* (2013.01); *H01H 13/85* (2013.01); *H01H 2205/016* (2013.01); *H01H 2215/012* (2013.01); *H01H 2217/016* (2013.01); *H01H 2217/024* (2013.01)

(58) Field of Classification Search
USPC ..... 200/406, 534
See application file for complete search history.

(56) References Cited

U.S. PATENT DOCUMENTS

2008/0251369 A1* 10/2008 Villain et al. ..... 200/534
2011/0284357 A1 11/2011 Yasunaga et al.

FOREIGN PATENT DOCUMENTS

JP 2011-243476 12/2011

* cited by examiner

*Primary Examiner* — Renee Luebke
*Assistant Examiner* — Ahmed Saeed
(74) *Attorney, Agent, or Firm* — Panasonic Patent Center

(57) ABSTRACT

A push switch of the present invention includes a case in which a concave portion is formed. The push switch of the present invention includes a movable member formed so as to be convex upward and arranged in the concave portion. The push switch of the present invention includes a protecting sheet provided above the movable member so as to cover the concave portion, the protecting sheet having an adhesive formed on a lower surface thereof. The push switch of the present invention is provided with an intermediate sheet between a lower surface of the adhesive and an upper surface of the movable member.

16 Claims, 6 Drawing Sheets

PUSH SWITCH

BACKGROUND

1. Technical Field

The present invention relates to a push switch used as an input operating unit of various electronic devices.

2. Description of the Related Art

Recently, various electronic devices are made compact, light-weight, and thin and have multiple functions. There is strong demand for a compact and thin push switch used as an operating unit of the electronic device with excellent feeling at the time of operation.

Such a conventional push switch is described with reference to FIGS. 5 to 7.

FIG. 5 is a cross-sectional view of the conventional push switch, FIG. 6 is an exploded perspective view of the conventional push switch, and FIG. 7 is a cross-sectional view of the conventional push switch in a pressing operation state. In FIGS. 5 to 7, a reference sign 1 represents a case formed of a synthetic resin into a substantially rectangular shape as seen from above having a concave portion with an opening on an upper portion thereof. Central fixed contact 2 having a truncated cone shape with a substantially circular shape as seen from above formed so as to slightly project upward is provided at the center of a bottom surface of the concave portion of case 1. Outer fixed contacts 3 formed to have a rectangular shape as seen from above so as to slightly project upward are provided in two positions point symmetric with respect to central fixed contact 2 in case 1. Terminal 2A connected to central fixed contact 2 and terminal 3A connected to outer fixed contact 3 are derived from case 1 outward.

Case 1 is formed by insert molding of central fixed contact 2, outer fixed contact 3, and terminals 2A and 3A corresponding to them.

A reference sign 5 represents a movable contact having an upward convex dome shape formed of an elastic metal thin plate with surface treatment with excellent conductivity applied to a lower surface thereof. A lower end of an outer edge of movable contact 5 is put on outer fixed contact 3 to be mounted in the concave portion of case 1. A lower surface of a central portion of movable contact 5 is opposed to an upper surface of central fixed contact 2 with a gap therebetween.

A reference sign 7 represents a protecting sheet formed of an insulating film having flexibility and acrylic adhesive 7A, for example, is applied to a lower surface of protecting sheet 7. Protecting sheet 7 is adhered to an upper surface of an outer periphery of case 1 with adhesive 7A on the lower surface thereof so as to cover the concave portion of case 1. A lower surface of a central portion of protecting sheet 7 is adhered to an upper surface of a central portion of movable contact 5.

A reference sign 9 represents a substantially cylindrical pressing projection formed of an insulating resin. Pressing projection 9 is arranged on an upper surface of protecting sheet 7 corresponding to the center of movable contact 5 to be adhered to protecting sheet 7 with an adhesive (not illustrated) formed on a lower surface of pressing projection 9.

The conventional push switch is configured as described above and operation thereof is described as follows.

When pressing projection 9 is pressed downward, pressing force is applied to the central portion of movable contact 5 through protecting sheet 7 below the same. When the pressing force becomes larger than predetermined force, as illustrated in FIG. 7, the central portion having the dome shape of movable contact 5 is elastically inverted so as to be convex downward with click feeling and the lower surface of the central portion of movable contact 5 is brought into contact with central fixed contact 2 below the same. According to this, a switch-on state in which outer fixed contact 3 and central fixed contact 2 are brought into conduction through movable contact 5 and corresponding terminals 2A and 3A are brought into conduction is obtained.

When the pressing force is released, the central portion having the dome shape of movable contact 5 elastically returns to its original upward convex shape together with the click feeling. According to this, it returns to a switch-off state in which the lower surface of the central portion of movable contact 5 separates from central fixed contact 2 and corresponding terminals 2A and 3A are insulated from each other.

Meanwhile, Unexamined Japanese Patent Publication No. 2011-243476 is known, for example, as a conventional art document related to the invention of this application.

SUMMARY

However, in the conventional push switch, protecting sheet 7 is adhered to an upper surface of movable contact 5 through adhesive 7A. Therefore, protecting sheet 7 and adhesive 7A thereof prevent inverting operation of movable contact 5 and operational feeling is blunted. Although countermeasures to make protecting sheet 7 and adhesive 7A thin so as to improve blunted operational feeling are taken, there is limitation.

The present invention provides the push switch, which prevents blunting of the operational feeling at the time of pressing operation.

A push switch of the present invention includes a case in which a concave portion is formed. The push switch of the present invention includes a movable member formed so as to be convex upward and arranged in the concave portion. The push switch of the present invention includes a protecting sheet provided above the movable member so as to cover the concave portion, the protecting sheet having an adhesive formed on a lower surface thereof. The push switch of the present invention is provided with an intermediate sheet between a lower surface of the adhesive and an upper surface of the movable member.

According to this, it is possible to prevent the protecting sheet from being adhered to an upper surface of a central portion of the movable member and it is possible to reduce prevention of the inverting operation of the movable member by the protecting sheet and the adhesive on the lower surface of the protecting sheet.

According to the present invention, the push switch having excellent click feeling in which the blunting of the operational feeling is decreased may be realized.

DETAILED DESCRIPTION OF THE PREFERRED EMBODIMENT

An embodiment of the present invention is hereinafter described with reference to FIGS. 1 to 4. Meanwhile, the same reference sign is assigned to a component the same as a conventional one and detailed description thereof is omitted.

Exemplary Embodiment

Figure 1:
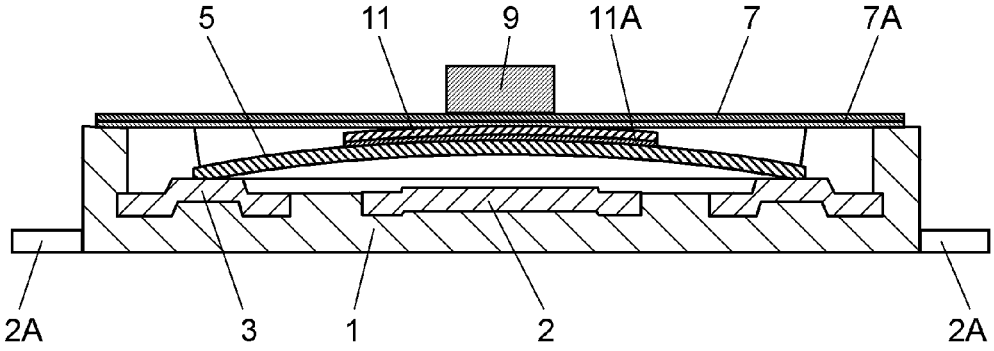
FIG. 1 is a cross-sectional view of a push switch according to an embodiment of the present invention.
Figure 2:
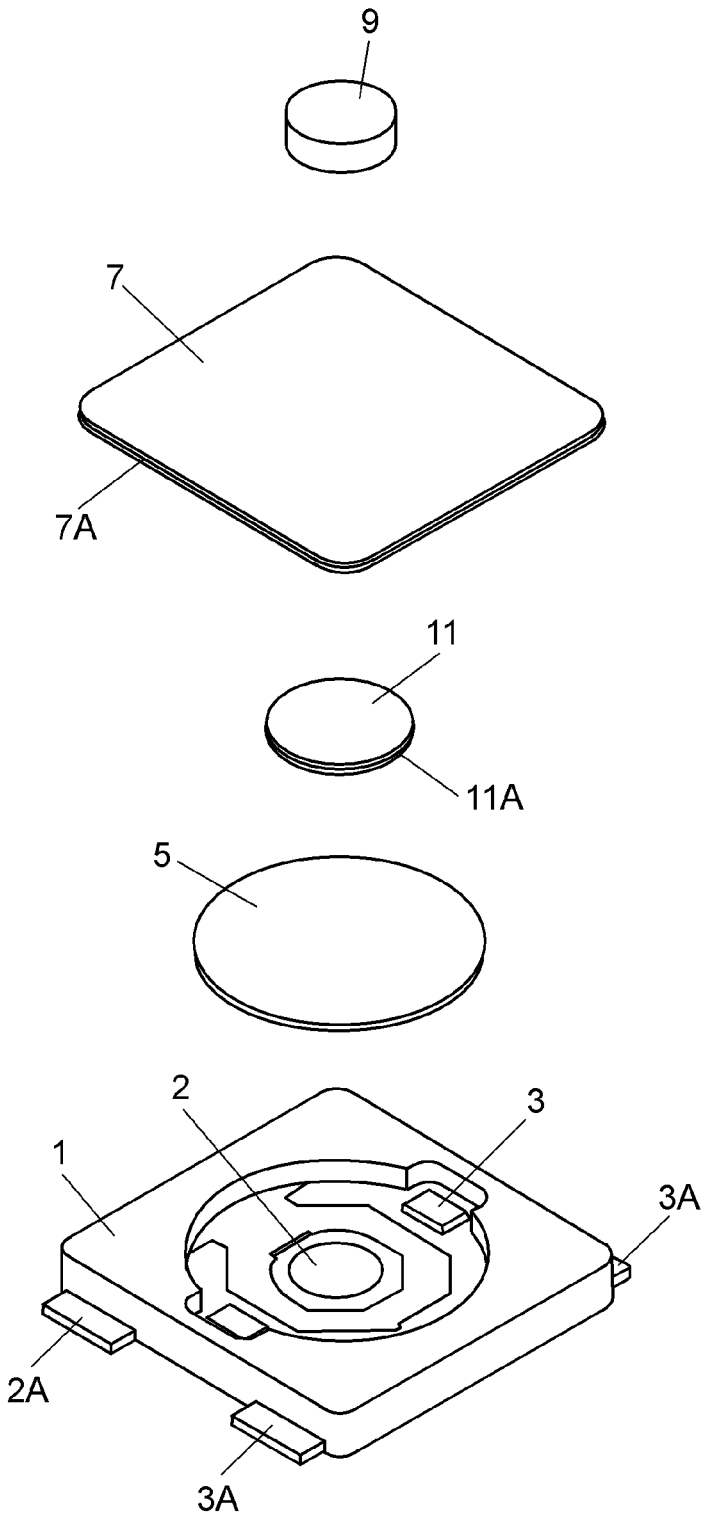
FIG. 2 is an exploded perspective view of the push switch according to the embodiment of the present invention.
Figure 3:
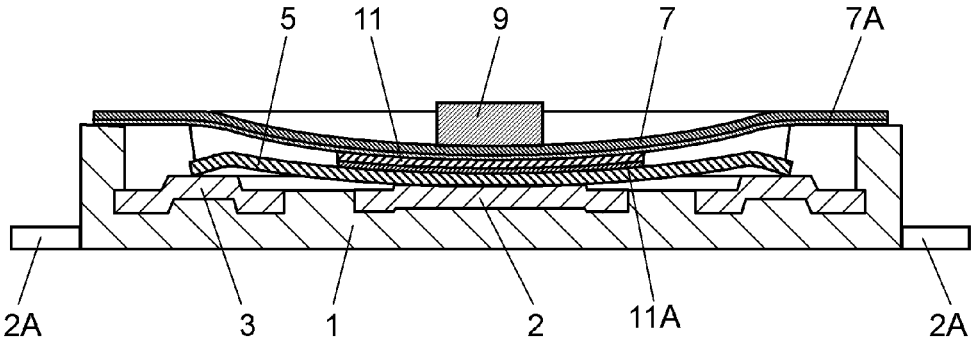
FIG. 3 is a cross-sectional view of the push switch according to the embodiment of the present invention in a pressing operation state.

FIG. 1 is a cross-sectional view of a push switch according to this embodiment and FIG. 2 is an exploded perspective view of the push switch of this embodiment. FIG. 3 is a cross-sectional view of the push switch of this embodiment in a pressing operation state.

As illustrated in FIGS. 1 to 3, case 1 is provided with central fixed contact 2 as a first fixed contact and outer fixed contact 3 as a second fixed contact arranged in a concave portion of which upper portion is opened. Terminal 2A connected to central fixed contact 2 and terminal 3A connected to outer fixed contact 3 are derived outward from a side surface portion of case 1.

Movable contact 5 as a movable member in claims of the present application is arranged in the concave portion of case 1 and a lower end of an outer edge of movable contact 5 is put on outer fixed contact 3. A lower surface of a central portion of movable contact 5 is opposed to an upper surface of central fixed contact 2 with a gap therebetween. Protecting sheet 7 is adhered to an upper surface of an outer periphery of case 1 by means of adhesive 7A on a lower surface of protecting sheet 7 so as to cover the concave portion of case 1.

Herein, the push switch of this embodiment is different from a conventional push switch in that intermediate sheet 11 is interposed between movable contact 5 and protecting sheet 7.

Intermediate sheet 11 is formed of an insulating film having flexibility into a substantially circular shape smaller than movable contact 5 as seen from above. This is adhered to an upper surface of the central portion of movable contact 5 by means of adhesive 11A provided on a lower surface of intermediate sheet 11. An upper surface of intermediate sheet 11 corresponding to the central portion of movable contact 5 is adhered to adhesive 7A on the lower surface of protecting sheet 7 with slight strength.

That is to say, the upper surface of intermediate sheet 11 is set to have a low affinity for adhesive 7A. For example, when adhesive 7A is acrylic, intermediate sheet 11 may be formed of a fluorine resin and the like such as polytetrafluoroethylene (PTFE).

Meanwhile, predetermined treatment for improving adhesiveness is applied to the lower surface of intermediate sheet 11. Therefore, adhesive 11A formed on the lower surface of intermediate sheet 11 is not easily removed from a base material and intermediate sheet 11 and movable contact 5 are adhered to each other with predetermined adhesion strength.

Meanwhile, large intermediate sheet 11 having a size with which adhesive 7A on the lower surface of protecting sheet 7 is not adhered to an upper surface of movable contact 5 in the above-described configuration is desirable.

Substantially cylindrical pressing projection 9 formed of an insulating resin is adhered to an upper surface of protecting sheet 7 corresponding to the center of movable contact 5 by means of an adhesive (not illustrated) formed on a lower surface thereof. The push switch of this embodiment is configured as described above.

Next, operation of the push switch of this embodiment is described. When pressing projection 9 is pressed downward, pressing force is applied to the central portion of movable contact 5 through protecting sheet 7 and intermediate sheet 11 below the same. When the pressing force becomes larger than predetermined force, as illustrated in FIG. 3, the central portion having a dome shape of movable contact 5 is elastically inverted so as to be convex downward together with click feeling and the lower surface of the central portion of movable contact 5 is brought into contact with central fixed contact 2 below the same. According to this, a switch-on state in which outer fixed contact 3 and central fixed contact 2 are brought into conduction through movable contact 5 and corresponding terminals 2A and 3A are brought into conduction is realized.

Herein, in the push switch of this embodiment, the adhesion strength between adhesive 7A on the lower surface of protecting sheet 7 and the upper surface of intermediate sheet 11 is slight so as to be smaller than the adhesion strength between adhesive 7A of protecting sheet 7 and the upper surface of movable contact 5 in the conventional push switch. According to this, inverting operation of movable contact 5 is realized with a small effect of protecting sheet 7 and adhesive 7A on the lower surface of protecting sheet 7.

In the push switch of this embodiment, an adhering position between adhesive 7A of protecting sheet 7 and the upper surface of intermediate sheet 11 is easily displaced at the time of the inverting operation of movable contact 5. According to this, an effect of deformation of protecting sheet 7 on the inverting operation of movable contact 5 is prevented.

As illustrated in FIG. 3, protecting sheet 7 is deformed so as to be convex downward by the pressing operation. That is to say, protecting sheet 7 and adhesive 7A are deformed in a direction of being pulled outward.

On the other hand, movable contact 5 and intermediate sheet 11 are inverted downward from an upward convex shape, so that they are deformed in a direction to be compressed inward.

Therefore, protecting sheet 7 is deformed outward and intermediate sheet 11 is deformed inward, respectively. Therefore, protecting sheet 7 and the upper surface of intermediate sheet 11 are deformed in opposing shear directions across a position in which both of them are adhered to each other as a boundary surface.

In the push switch of this embodiment, the adhesion strength between adhesive 7A on the lower surface of protecting sheet 7 and intermediate sheet 11 is small as described above, so that the adhering position may be easily displaced at the time of the inverting operation of movable contact 5. According to this, the inverting operation of movable contact 5 is realized without an effect of both of protecting sheet 7 and movable contact 5 deformed in the shear direction on each other, so that excellent click feeling may be obtained.

Meanwhile, intermediate sheet 11 may be formed of the above-described highly flexible fluorine resin such as PTFE and adhesive 11A thereof may be formed of highly flexible adhesive such as acrylic one. In such a case, since intermediate sheet 11 may be easily bent in the same direction along movable contact 5 even when this is in a state of being adhered to movable contact 5, intermediate sheet 11 and adhesive 11A thereof scarcely inhibit the inverting operation of movable contact 5. Therefore, blunting of operational feeling is slight and there is not a problem in practical use.

Figure 7:
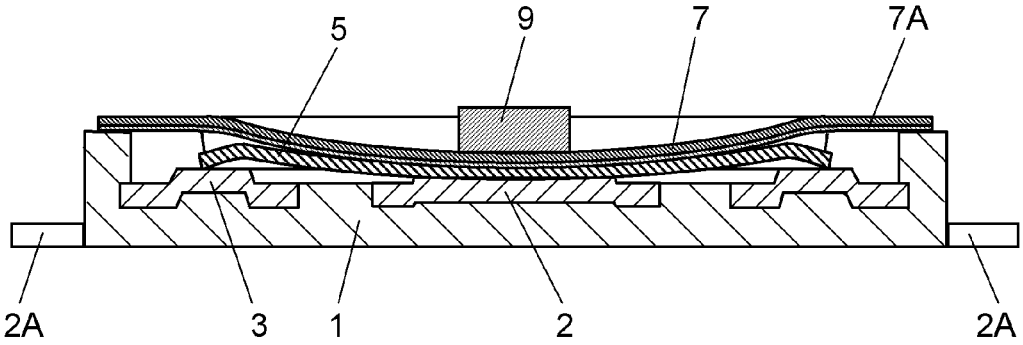
FIG. 7 PRIOR ART
FIG. 7 is a cross-sectional view of the conventional push switch in a pressing operation state.

On the other hand, in the conventional push switch, the above-described deformation in the shear direction occurs in the adhering position between adhesive 7A and the upper surface of movable contact 5 illustrated in FIG. 7. Since the adhesion strength is large, the above-described adhering position is not easily displaced and protecting sheet 7 and movable contact 5 pull each other to inhibit the inverting operation of movable contact 5. According to this, the operational feeling is blunted.

Next, when the pressing force is released, the central portion having the dome shape of movable contact 5 elastically returns to its original upward convex shape together with the click feeling. According to this, it returns to a switch-off state illustrated in FIG. 1 in which the central portion of movable contact 5 is separated from central fixed contact 2 and corresponding terminals 2A and 3A are insulated from each other.

Also when the pressing force is released, the adhering position of the upper surface of intermediate sheet 11 and adhesive 7A is easily displaced in the shear direction. According to this, protecting sheet 7 and adhesive 7A do not inhibit elastic return of movable contact 5 and movable contact 5 performs inverting operation.

As described above, according to this embodiment, there is intermediate sheet 11 between movable contact 5 and protecting sheet 7. Further, the upper surface of intermediate sheet 11 with the low affinity for adhesive 7A on the lower surface of protecting sheet 7 is used. According to this, the adhesion strength between both of them is made smaller than the adhesion strength between adhesive 7A of protecting sheet 7 and the upper surface of movable contact 5 in the conventional push switch to prevent the inverting operation of movable contact 5 from being inhibited. As a result, the push switch with excellent click feeling in which blunting of the operational feeling is decreased may be obtained.

Figure 4:
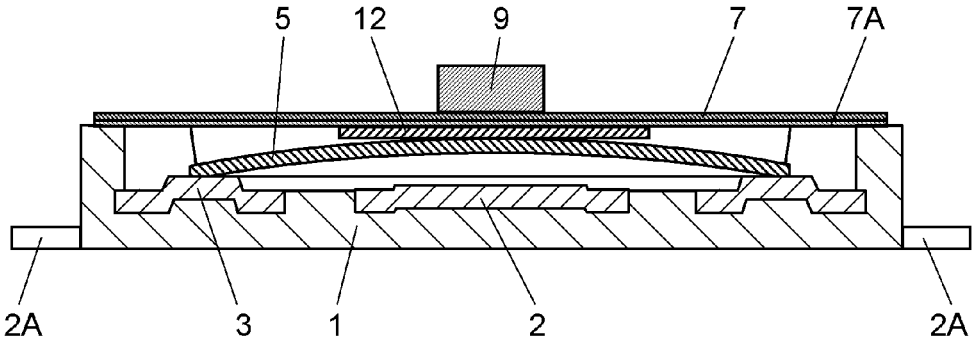
FIG. 4 is a cross-sectional view of a push switch according to another embodiment of the present invention.
Figure 5:
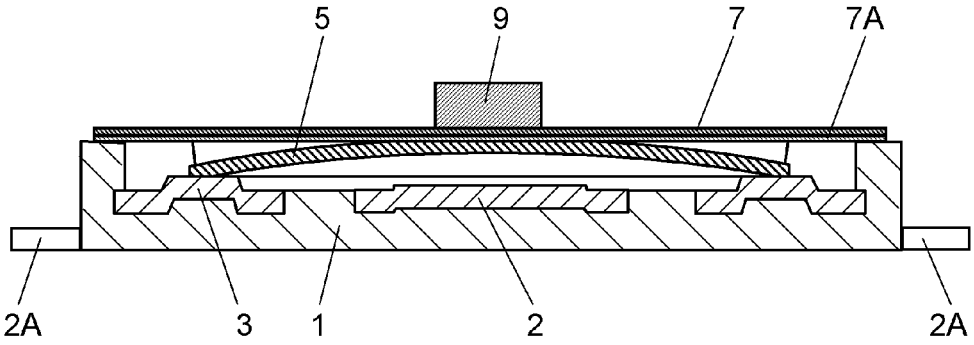
FIG. 5 PRIOR ART
FIG. 5 is a cross-sectional view of a conventional push switch.
Figure 6:
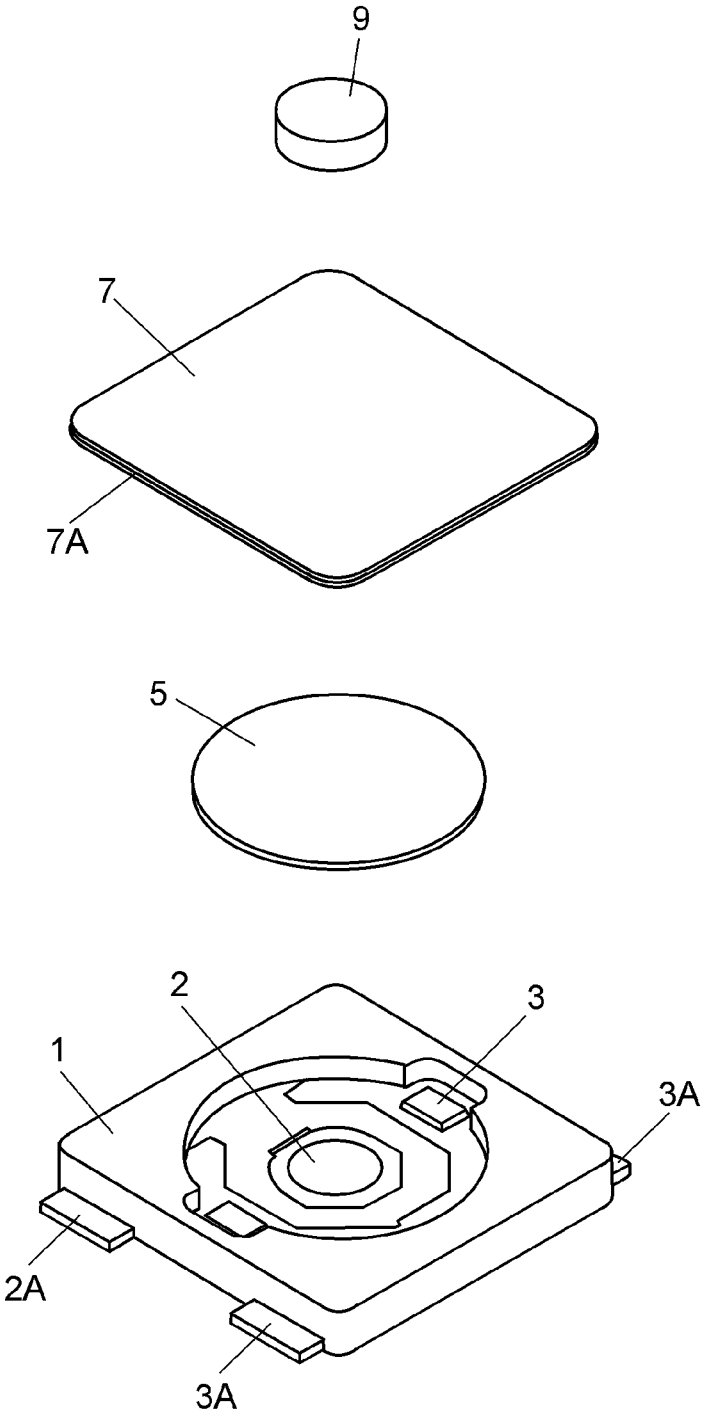
FIG. 6 PRIOR ART
FIG. 6 is an exploded perspective view of the conventional push switch.

Meanwhile, the configuration in which intermediate sheet 11 is adhered to the upper surface of movable contact 5 by means of adhesive 11A on a lower surface thereof is described above as this embodiment. Another embodiment is further described. FIG. 4 is a cross-sectional view of a push switch according to another embodiment. As illustrated in FIG. 4, intermediate sheet 12 formed of an insulating film excellent in flexibility having a substantially circular shape as intermediate sheet 11 as seen from above without an adhesive on both of upper and lower surfaces is adhered to a lower surface of protecting sheet 7 by means of adhesive 7A. Meanwhile, a material of intermediate sheet 12 is not especially limited.

In another embodiment, the upper surface of intermediate sheet 12 is adhered to the lower surface of protecting sheet 7 and the lower surface of intermediate sheet 12 is not adhered to movable contact 5.

In the push switch of another embodiment, intermediate sheet 12 is deformed outward and movable contact 5 is deformed inward at the time of inverting operation of movable contact 5 by pressing operation. Herein, since both of them are not adhered to each other on a boundary surface, both of intermediate sheet 12 and movable contact 5 deformed in a shear direction on the boundary surface do not affect each other. Therefore, the inverting operation of movable contact 5 is performed smoothly and excellent click feeling may be realized.

Meanwhile, the push switch according to the idea of the present invention may also prevent the feeling in a low-temperature environment from blunting.

That is to say, in the conventional push switch, flexibility of protecting sheet 7 decreases and a degree of viscosity of adhesive 7A increases along with fall in temperature, so that the blunting of the operational feeling is larger than that at a normal temperature. On the other hand, in the push switch of the present invention, intermediate sheet 11 or 12, which prevents adhesive 7A of protecting sheet 7 and an upper surface of a central portion of movable contact 5 from being directly adhered to each other, is interposed in any of the above-described configurations. Since protecting sheet 7 and movable contact 5 are adhered with slight adhesion or not adhered to each other, protecting sheet 7 and adhesive 7A on the lower surface thereof do not prevent the inverting operation of movable contact 5 even in a low-temperature environment. According to this, the blunting of the operational feeling may be prevented.

Meanwhile, although substantially cylindrical pressing projection 9 is provided in a position on an upper surface of protecting sheet 7, a shape of the pressing projection is not limited and this may have a polygonal shape, a truncated cone shape and the like. Further, it is also possible that pressing projection 9 is not provided.

Figure 8:
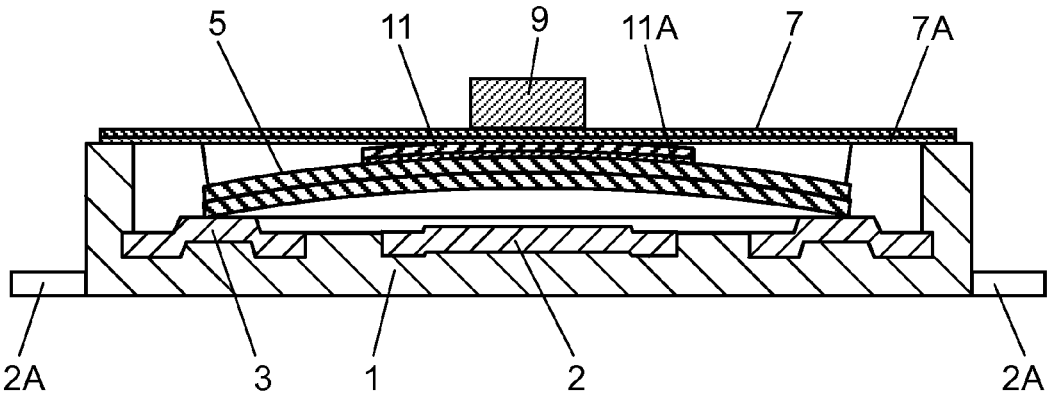
FIG. 8 is a cross-sectional view of a push switch according to another embodiment.

Also, a shape of the movable member is not limited to a circular shape as seen from above as that of movable contact 5 described above and may be an outer shape formed into a strip shape, a polygonal shape, an oval shape, a substantially elliptical shape and the like. Further, it is also possible to arrange a plurality of movable members in an overlapped manner as shown in FIG. 8.

Meanwhile, a so-called vertically press type used by being pressed in a direction perpendicular to a surface of the wiring substrate on which this is mounted is described in this embodiment. However, the idea of the present invention may also be applied to a so-called horizontally press type used by being pressed in a direction horizontal to the surface of the wiring substrate on which this is mounted and the like.

The push switch according to the present invention may be realized as the switch with excellent click feeling in which the blunting of the operational feeling is decreased and this is useful mainly for an operating unit of various electronic devices.

What is claimed is:

1. A push switch, comprising:

a case in which a concave portion is formed;

a movable member formed so as to be convex upward and arranged in the concave portion; and a protecting sheet provided above the movable member so as to cover the concave portion, the protecting sheet having an adhesive on a lower surface thereof, wherein an intermediate sheet is provided between a lower surface of the adhesive and an upper surface of the movable member, the intermediate sheet is adhered to the upper surface of the movable member, and adhesiveness between an upper surface of the intermediate sheet and the adhesive of the protecting sheet is smaller than adhesiveness between the movable member and the adhesive of the protecting sheet.

2. The push switch according to claim 1, wherein the adhesive of the protecting sheet is formed of an acrylic material and the intermediate sheet is formed of a fluorine resin material.

3. The push switch according to claim 1, wherein the intermediate sheet is adhered to the lower surface of the adhesive of the protecting sheet.

4. The push switch according to claim 3, wherein adhesiveness between a lower surface of the intermediate sheet and the movable member is smaller than the adhesiveness between the movable member and the adhesive of the protecting sheet.

5. The push switch according to claim 1, further comprising a pressing projection provided on an upper surface of the protecting sheet.

6. The push switch according to claim 1, wherein the movable member generates operational feeling by pressing operation.

7. The push switch according to claim 1, further comprising:

a first fixed contact provided at a center of a bottom surface in the concave portion; and a second fixed contact provided on a periphery of the bottom surface in the concave portion, wherein a peripheral portion of the movable member is connected to the second fixed contact, and a central portion of the movable member is located above apart from the first fixed contact.

8. The push switch according to claim 1, wherein the movable member includes a plurality of members.

9. A push switch, comprising:

a case in which a concave portion is formed;

a movable member formed so as to be convex upward and arranged in the concave portion; and a protecting sheet provided above the movable member so as to cover the concave portion, the protecting sheet having an adhesive on a lower surface thereof, wherein an intermediate sheet is provided between a lower surface of the adhesive and an upper surface of the movable member, and adhesiveness between an upper surface of the intermediate sheet and the adhesive of the protecting sheet is smaller than adhesiveness between the movable member and the adhesive of the protecting sheet.

10. The push switch according to claim 9, wherein the adhesive of the protecting sheet is formed of an acrylic material and the intermediate sheet is formed of a fluorine resin material.

11. The push switch according to claim 9, wherein the intermediate sheet is adhered to the lower surface of the adhesive of the protecting sheet.

12. The push switch according to claim 11, wherein adhesiveness between a lower surface of the intermediate sheet and the movable member is smaller than the adhesiveness between the movable member and the adhesive of the protecting sheet.

13. The push switch according to claim 9, further comprising a pressing projection provided on an upper surface of the protecting sheet.

14. The push switch according to claim 9, wherein the movable member generates operational feeling by pressing operation.

15. The push switch according to claim 9, further comprising:

a first fixed contact provided at a center of a bottom surface in the concave portion; and a second fixed contact provided on a periphery of the bottom surface in the concave portion, wherein a peripheral portion of the movable member is connected to the second fixed contact, and a central portion of the movable member is located above apart from the first fixed contact.

16. The push switch according to claim 9, wherein the movable member includes a plurality of members.

* * * * *